US008424547B1

(12) United States Patent
Ma et al.

(10) Patent No.: US 8,424,547 B1
(45) Date of Patent: Apr. 23, 2013

(54) SAFETY BUCKLE OF UMBRELLA RUNNER

(76) Inventors: Joen-Shen Ma, Taipei (TW); Yung Cheng Ma, Taipei (TW)

( * ) Notice: Subject to any disclaimer, the term of this patent is extended or adjusted under 35 U.S.C. 154(b) by 0 days.

(21) Appl. No.: 13/372,704

(22) Filed: Feb. 14, 2012

(51) Int. Cl.
*A45B 25/08* (2006.01)

(52) U.S. Cl.
USPC ..... 135/40; 135/28; 135/38

(58) Field of Classification Search ..... 135/28–30, 135/37–41; 211/197
See application file for complete search history.

(56) References Cited

U.S. PATENT DOCUMENTS 985,842 A * 3/1911 Roney ..... 135/28
1,202,063 A * 10/1916 Heyn ..... 135/41
3,156,249 A * 11/1964 Biderman ..... 135/15.1
3,856,032 A * 12/1974 Schafer ..... 135/28
4,033,366 A * 7/1977 Forget ..... 135/98
5,566,699 A * 10/1996 Kou ..... 135/28
5,740,824 A * 4/1998 Tang ..... 135/28
7,204,261 B1 * 4/2007 Wu ..... 135/28
7,806,130 B2 * 10/2010 Gobel ..... 135/28

* cited by examiner

*Primary Examiner* — Winnie Yip
(74) *Attorney, Agent, or Firm* — Rosenberg, Klein & Lee

(57) ABSTRACT

A safety buckle of umbrella is mounted in receiving compartments formed in a runner. The safety buckle is generally a U-shaped having two limbs each forming a hook latch. Two pivot pins are respectively mounted to opposite side surfaces of the buckle and torsion springs are respectively fit to the pivot pins to provide the hook latches with spring biasing force for engagement. The pivot pins of the safety buckle are respectively received in pivot holes defined in inside surfaces of the receiving compartments. To open the umbrella, the runner is moved upward along a center post. A user presses down the safety buckle when the runner gets close to positioning pins formed on the center post to allow the hook latches to respectively engage the positioning pins thereby securely fixing the runner in position on the center post.

1 Claim, 6 Drawing Sheets

SAFETY BUCKLE OF UMBRELLA RUNNER

BACKGROUND OF THE INVENTION

1. Field of the Invention

The present invention relates to a safety buckle of umbrella runner, and in particular to a safety operation technique of umbrella that is applicable to all sorts of umbrellas to ensure secured and reliable positioning of a runner in the expansion of the umbrella.

2. The Related Arts

Umbrellas that serve as sunshades and rainshades are generally categorized in two types, of which one is a portable device, such as a folding umbrella, and the other is a fixed device, such as a large-sized umbrella, including a beach parasol and an advertisement umbrella. Both the portable umbrella and the fixed umbrella are of similar operation by moving a runner along a center post to allow the runner to push up and thus open a canopy or by moving the runner downward to collapse the canopy and thus close the umbrella. Further, when the umbrella is opened, the runner that is moved upward along the center post must be kept at a predetermined location on the center post to maintain the canopy in the opened condition.

One of the most common way that can be observed in the conventional umbrellas to fix the runner at the fixed position along the center post that maintain the umbrella in the open condition is to provide a resiliency-operating stop element on the center post. When the runner is moved upward along the center post to reach a position above the stop element, the stop element is allowed to project outward to stop downward movement of the runner in the reversed direction so as to keep the runner in position. A major disadvantage of such an arrangement is that a number of parts must be mounted inside an interior hollow space of the center post, making the structure complicated, and malfunctioning may be easily caused by an unexpected or undesired external impact, leading to spontaneous and unconstrained downward movement of the runner, which causes safety problem and makes the operation of umbrella unreliable.

SUMMARY OF THE INVENTION

An objective of the present invention is to overcome the above discussed drawback of the conventional umbrellas in properly positioning the runner by providing a safety buckle of umbrella runner.

The safety buckle of umbrella runner is applicable to all sorts of umbrella to ensure secured positioning of the runner when the umbrella and is thus an umbrella safety related technique.

To achieve the objective, the following technical solution is adopted in the present invention:

The runner safety buckle according to the present invention is mounted inside receiving compartments formed in a runner of an umbrella.

The receiving compartments are formed in opposite portions of the runner and each of the two receiving compartments has an inside surface forming a pivot hole and an aperture.

The safety buckle is made in a U-shape, which has two limbs each forming, in a free end thereof, a hook latch. Pivot pins are respectively mounted to opposite outer sides of the safety buckle. Each of the pivot pins receives a torsion spring fit thereon.

The pivot pins on the two sides of the safety buckle are respectively received in the pivot holes that are formed in the inside surfaces of the receiving compartments formed in the two opposite side portions of the runner.

The torsion spring has an end fixed to the safety buckle and an opposite end received and fixed in the aperture of the respective receiving compartment of the runner so that the torsion springs provide the two hook latches of the safety buckle with necessary spring biasing forces for engagement.

According to the present invention, in opening the umbrella, the runner is moved upward along the center post. When the runner is getting close to the positioning pins of the center post, a user may first press down the safety buckle to allow the two hook latches to respectively engage the positioning pins and then releases the safety buckle.

When the two hook latches get into engagement with the positioning pins, the torsion springs provide the two hook latches with spring biasing forces that securely fix the runner in position on the center post to maintain a secured and reliable umbrella open condition.

To close the umbrella, the user presses down the safety buckle again to have the two hook latches disengaging from the positioning pins, thereby allowing the runner to be pulled down for closing the umbrella. The operation is easy and effortless.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
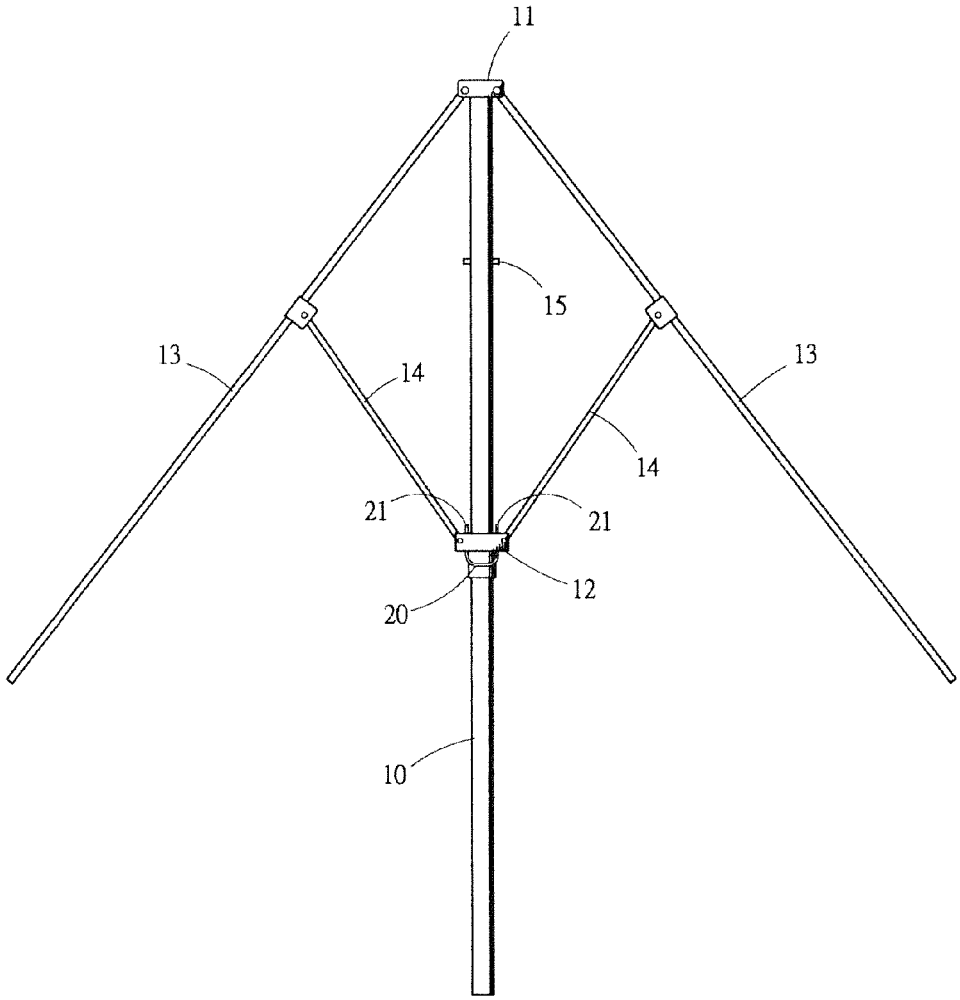
FIG. 1 is a schematic view showing an umbrella having a center post to which a runner safety buckle according to the present invention is mounted.

FIG. 1 is a schematic view showing an umbrella having a center post to which a runner safety buckle according to the present invention is mounted.

Figure 2:
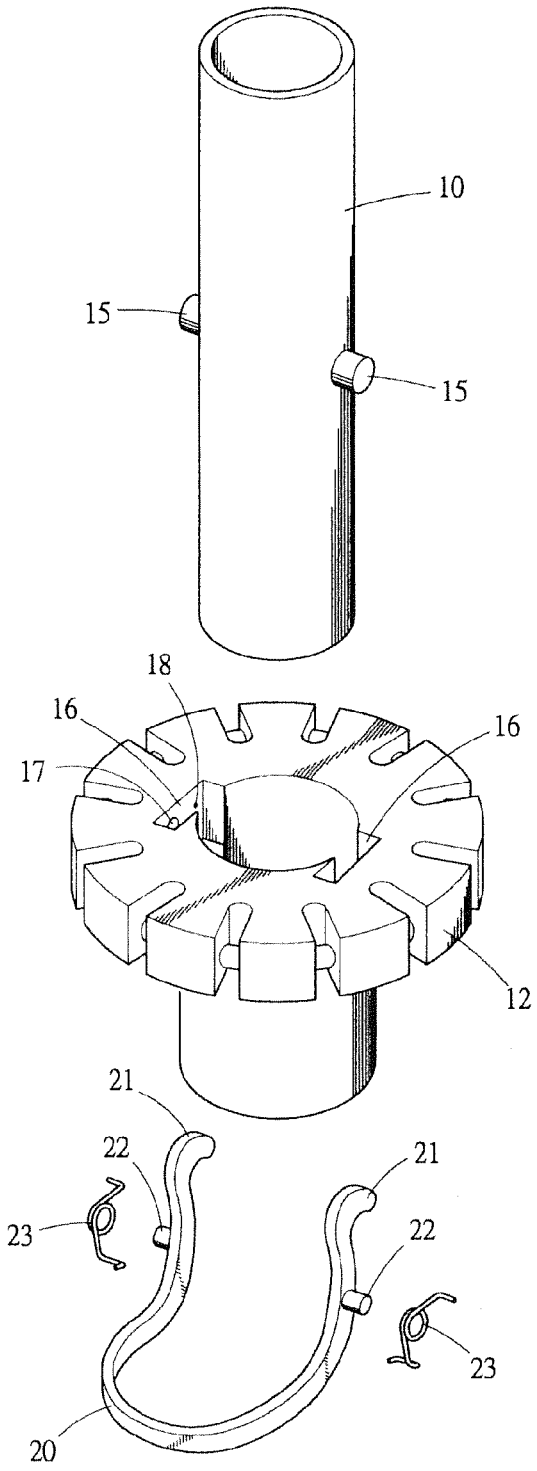
FIG. 2 is an exploded view illustrating the runner safety buckle according to the present invention.

FIG. 2 is an exploded view illustrating the runner safety buckle according to the present invention.

As shown in FIGS. 1 and 2, the runner safety buckle according to the present invention is to be mounted inside two receiving compartments 16 formed in a runner 12 of an umbrella.

As shown in FIG. 1, the umbrella comprises a center post 10, a crown 11, a runner 12, ribs 13, and stretchers 14.

The center post 10 comprises positioning pins 15 that are mounted to the center post 10 at a predetermined vertical position. The crown 11 is fixed at a top of the center post 10. The runner 12 is fit over the center post 10 to be slidable vertically for movement. Each of the ribs 13 has an upper end pivoted to the crown 11. Each of the stretchers 14 has an upper end pivoted to a middle of each rib 13. Each stretcher 14 has a lower end pivoted to the runner 12.

As shown in FIG. 2, the runner 12 forms the receiving compartments 16 and also forms a pivot hole 17 and an aperture 18 in an inside surface of each of the two receiving compartments 16.

As shown in FIG. 2, the safety buckle 20 is made in a U-shape, which has two limbs each forming, in a free end thereof, a hook latch 21. Two pivot pins 22 are respectively mounted to opposite outer sides of the safety buckle 20. Each of the pivot pins 22 receives a torsion spring 23 fit thereon.

When the safety buckle 20 is mounted to the runner 12, the pivot pins 22 on the two sides of the safety buckle 20 are respectively received in the pivot holes 17 that are formed in the inside surfaces of the two receiving compartments 16 formed in the two opposite side portions of the runner 12. The torsion spring 23 has an end fixed to the safety buckle 20 and an opposite end received and fixed in the aperture 18 of the respective receiving compartment 16 of the runner 12. The torsion springs 23 provide the two hook latches 21 of the safety buckle 20 with necessary spring biasing forces for engagement.

Figure 3:
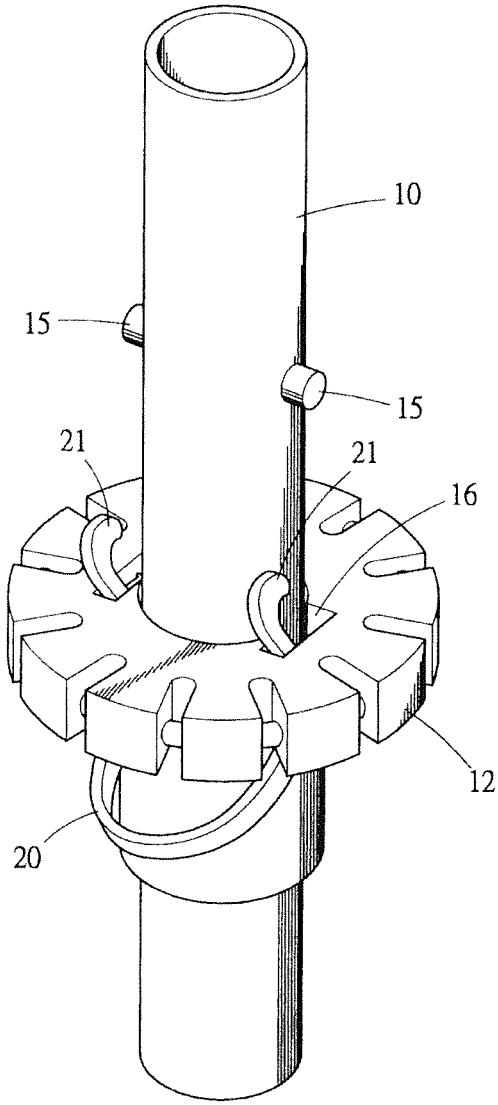
FIG. 3 is a perspective view, in an assembled form, showing a hook latch of the runner safety buckle of the present invention is not in engagement with a positioning pin, thereby allowing a runner to move along the center post.

FIG. 3 is a perspective view, in an assembled form, showing the hook latches 21 of the safety buckle 20 are not in engagement with the positioning pins 15, thereby allowing the runner 12 to move along the center post 10.

Figure 4:
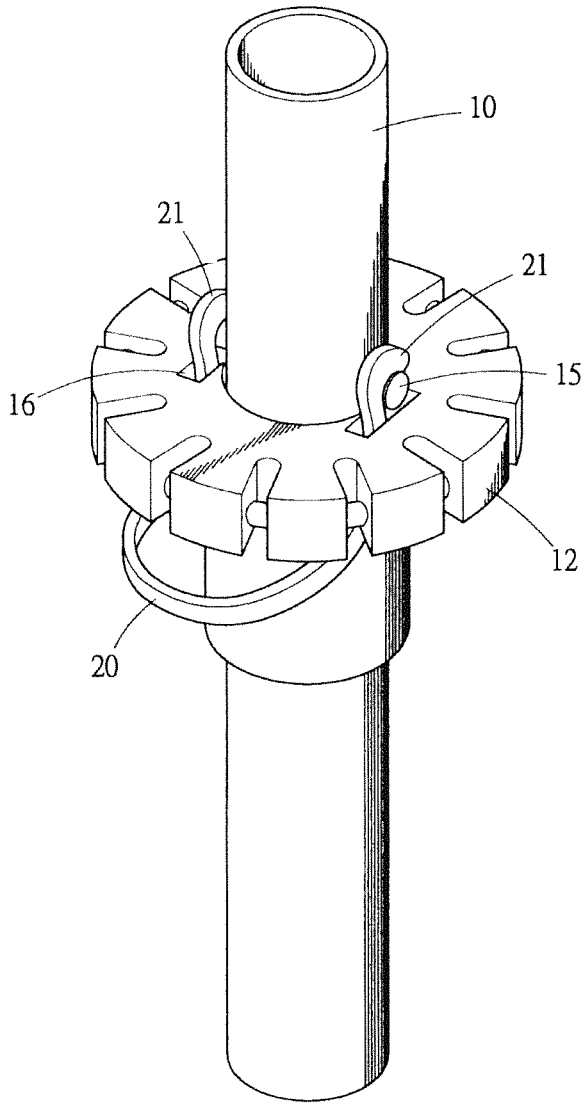
FIG. 4 is a perspective view, in an assembled form, showing the hook latch of the runner safety buckle of the present invention is set in engagement with the positioning pin, thereby securing the runner in position on the center post.

FIG. 4 is a perspective view, in an assembled form, showing the hook latches 21 of the safety buckle 20 are set in engagement with the positioning pins 15, thereby securing the runner 12 in position on the center post.

Figure 5:
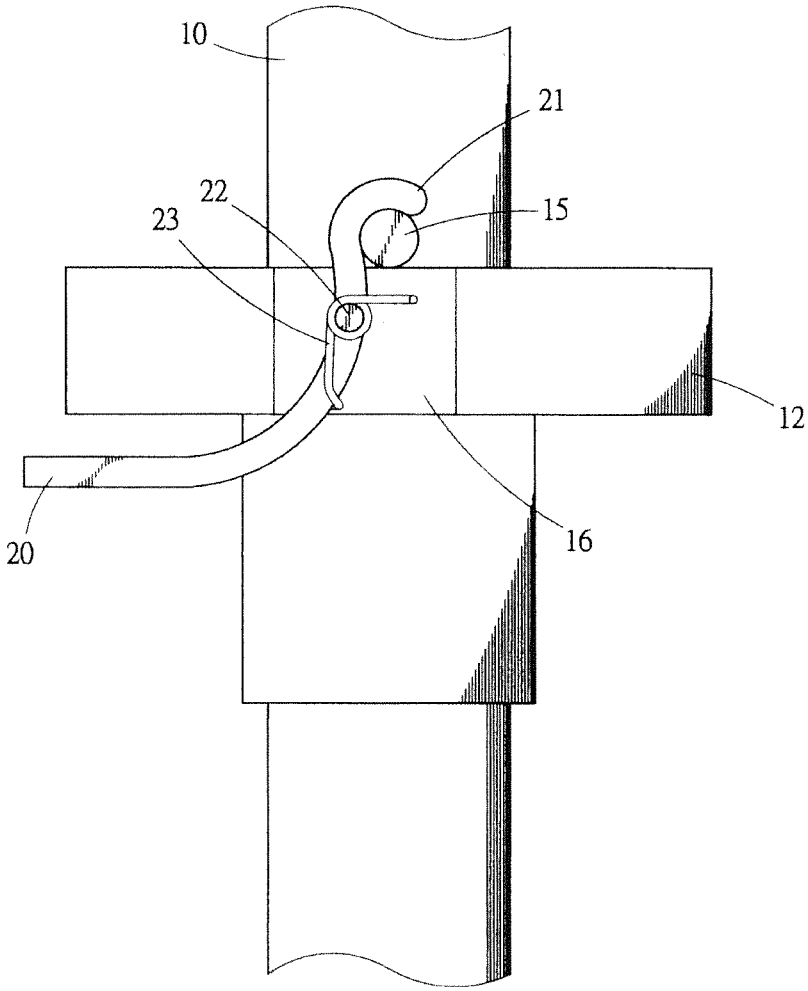
FIG. 5 is a side elevational view of FIG. 4.

FIG. 5 is a side elevational view of FIG. 4.

According to the present invention, in opening the umbrella, the runner 12 is moved upward along the center post 10. When the runner 12 is getting close to the positioning pins 15 of the center post 10, as show in FIG. 3, a user may first press down the safety buckle 20 to allow the two hook latches 21 to respectively engage the positioning pins 15 and then releases the safety buckle, as shown in FIG. 4.

When the two hook latches 21 get into engagement with the positioning pins 15, the torsion springs 23 provide the two hook latches 21 with spring biasing forces that securely hold the hook latches in engagement with the positioning pins, thereby securely fixing the runner 12 in position on the center post 10, as shown in FIGS. 4 and 5, to maintain a secured and reliable umbrella open condition.

To close the umbrella, the user presses down the safety buckle 22 again to have the two hook latches 21 disengaging from the positioning pins 15, thereby allowing the runner 12 to be pulled down for closing the umbrella. The operation is easy and effortless.

Figure 6:
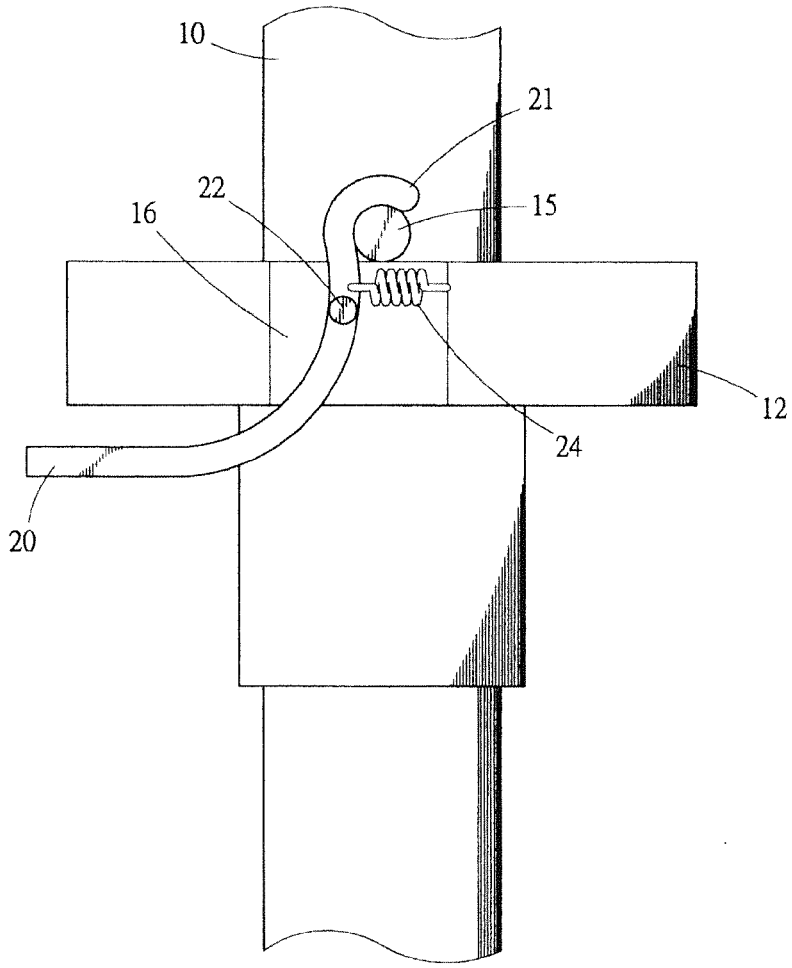
FIG. 6 is a side elevational view illustrating a different embodiment of the runner safety buckle of the present invention in which an extension spring is used.

FIG. 6 is a side elevational view illustrating a different embodiment of the runner safety buckle of the present invention in which extension springs 24 are used.

In the embodiment illustrated in FIG. 6, the torsion springs 23 of FIG. 5 are replaced by extension springs 24. Each of the extension springs 24 has an end fixed to the safety buckle 20 at a position above the pivot pin 22 and an opposite end connected to the runner 12. This arrangement also provides the two hook latches 21 with spring biasing forces for engagement.

The present invention shows several apparent advantages. The runner safety buckle of the present invention, as a whole, is of a simple structure. And in mounting to the runner, it only uses an unused portion of the runner so that no modification or damage may be made on the center post. The safety buckle of the present invention needs fewer parts and is easy to assemble, and may realize secured and reliable positioning of the runner, thereby overcoming the drawback of the conventional runner positioning device for umbrella.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A runner safety buckle, which is mounted inside receiving compartments defined in a runner of an umbrella, the umbrella comprising a center post, a crown, the runner, ribs, and the stretchers, the center post comprising positioning pins that are mounted to the center post at a predetermined vertical position, the crown being fixed at a top of the center post, the runner being fit over the center post to be slidable vertically for movement, each of the ribs having an upper end pivoted to the crown, each of the stretchers having an upper end pivoted to a middle of each rib and a lower end pivoted to the runner, characterized in that:

the runner forms the receiving compartments and also forms a pivot hole and an aperture in an inside surface of each of the two receiving compartments;

the safety buckle is made in a U-shape, which has two limbs each forming, in a free end thereof, a hook latch, two pivot pins being respectively mounted to opposite outer sides of the safety buckle, each of the pivot pins receiving a torsion spring fit thereon;

wherein the safety buckle is mounted to the runner, the pivot pins on the two sides of the safety buckle are respectively received in the pivot holes that are formed in the inside surfaces of the two receiving compartments formed in the two opposite side portions of the runner; and each of the torsion springs has an end fixed to the safety buckle and an opposite end received and fixed in the aperture of the respective receiving compartment of the runner, so that the torsion springs provide the two hook latches of the safety buckle with spring biasing forces for engagement with the positioning pines of the center post to secure the runner in position and thus maintain a secured and reliable umbrella open condition.

* * * * *